US006446828B1

(12) United States Patent
Casteel

(10) Patent No.: US 6,446,828 B1
(45) Date of Patent: Sep. 10, 2002

(54) SERVING PLATE WITH BEVERAGE HOLDER

(76) Inventor: Ronald Clay Casteel, 2891 Glen Echo Dr., Lizella, GA (US) 31052

( * ) Notice: Subject to any disclaimer, the term of this patent is extended or adjusted under 35 U.S.C. 154(b) by 0 days.

(21) Appl. No.: 09/708,399

(22) Filed: Nov. 8, 2000

Related U.S. Application Data

(60) Provisional application No. 60/164,017, filed on Nov. 8, 1999.

(51) Int. Cl.[7] ..... B65D 25/30

(52) U.S. Cl. ..... 220/575; 220/23.83; 220/771; 220/756

(58) Field of Search ..... 206/561, 562, 206/557; 220/23.83, 23.8, 575, 771, 737, 756

(56) References Cited

U.S. PATENT DOCUMENTS

| | | | | | |
|---|---|---|---|---|---|
| 4,732,274 | A | * | 3/1988 | Booton | 206/561 |
| 4,823,958 | A | * | 4/1989 | Mahmud | 220/561 |
| 4,867,331 | A | * | 9/1989 | Task | 220/23.8 |
| 5,207,743 | A | * | 5/1993 | Costarella et al. | 220/574 |
| 5,441,164 | A | * | 8/1995 | Beck et al. | 220/575 |

* cited by examiner

*Primary Examiner*—Joseph M. Moy
(74) *Attorney, Agent, or Firm*—Harry I. Leon; Vivian L. Steadman

(57) ABSTRACT

A serving tray partially surrounding a beverage holder with which it is integrally molded to form a single, one piece unit. The beverage holder extends downwardly of the tray and serves both as a container and as a handle. Fluids can be stored in the beverage holder itself and consumed therefrom, using a straw. Alternately, a canned beverage or standard size disposable drinking cup can be snap-fitted within the beverage holder. Disposed with bilateral symmetry about the longitudinal centerline of the beverage holder, the tray extends generally perpendicularly therefrom, as does a flat surface on the bottom of the beverage holder, so that when the latter rests upright on a table, the tray extends approximately horizontally. Within the tray itself is situated a plurality of watertight, shallow open compartments, separated from each other by at least one dividing wall whose distal ends link an outer wall of the tray with the side wall of the beverage holder. Fabricated of a plastic which is both dishwasher proof and microwaveable for reuse or, alternately, as a disposable article of paper, biodegradable plastic, or the like, both the tray and the beverage holder are shaped so that two or more units can be stacked together to facilitate storage and transport.

5 Claims, 2 Drawing Sheets

SERVING PLATE WITH BEVERAGE HOLDER

CROSS REFERENCE TO RELATED U.S. PATENT APPLICATION

This application contains subject matter disclosed in my provisional patent application having Ser. No. 60/164,017, filed Nov. 8, 1999.

BACKGROUND OF THE INVENTION

In the prior art, party food plates have generally flat bottom surfaces; and the upper side of such a plate defines at least one shallow depression for holding edibles. Often the shallow depression is subdivided by one or more ridges, creating individual compartments.

Once a partygoer fills his plate, he usually proceeds to get a beverage, typically served in a glass or disposable cup. The user finds himself juggling the plate in one hand and the cup in the other, unable to pick up additional items or to eat. He must first find a place to set down either the plate or the cup or both; but, at many parties, guests end up standing and holding both items for extended periods of time.

SUMMARY OF THE INVENTION

The object of the present invention is to provide a hand-held article for use by individual partygoers and the like which includes, in one unit, a beverage holder and a tray defining a plurality of compartments for serving a variety of foodstuffs.

It is a further object that the article according to the present invention be well balanced and easily held with one hand.

A still further object is to provide such an article which is stable when set upright on a horizontal surface.

A still further object is to provide such an article which is stackable so that multiple units of it can be readily packaged and transported.

In accordance with the present invention, there is provided an article having a tray and beverage holder which are integrally molded to form a single, one piece unit. Alternately, the article is formed by pressing it from a thin sheet of aluminum or other malleable material.

Centrally disposed and surrounded by the tray is an elongated, open compartment which forms the beverage holder. In the preferred embodiment, the beverage holder extends downwardly of the tray a substantial distance and serves as a handle with which to grasp the article. A wide, flat surface on the bottom of the beverage holder enables the article to be set upright on a table or other horizontal surface, with the tray held in an approximately level position. The open compartment in the beverage holder is sized to accommodate standard metal beverage cans and standard size disposable drinking cups. Alternately, a consumer can drink a beverage directly from the holder with the use of a straw. For the latter purpose, the holder is preferably equipped with a snap-on lid.

So that two or more articles according to the present invention can be stacked one within the other, both the elongated, open compartment and the outer side wall of the beverage holder, below the tray, taper downwardly and inwardly, generally resembling an imaginary truncated cone.

Within the tray itself is situated a plurality of watertight, shallow, open compartments, separated from each other by at least one dividing wall. Preferably, distal ends of the dividing wall link an outer wall of the tray with the side wall of the beverage holder. To keep the center of gravity of the article at a point within the confines of the beverage holder so that the article, when loaded with food, is stable in its upright position, the shallow, open compartments are disposed in such a way that the footprint of the tray exhibits at least bilateral symmetry about the longitudinal centerline of the beverage holder. Moreover, when the beverage holder is filled with liquid or, alternately, a canned beverage is held therein, the stability of the article is enhanced.

DETAILED DESCRIPTION OF THE PREFERRED EMBODIMENT

Figure 1:
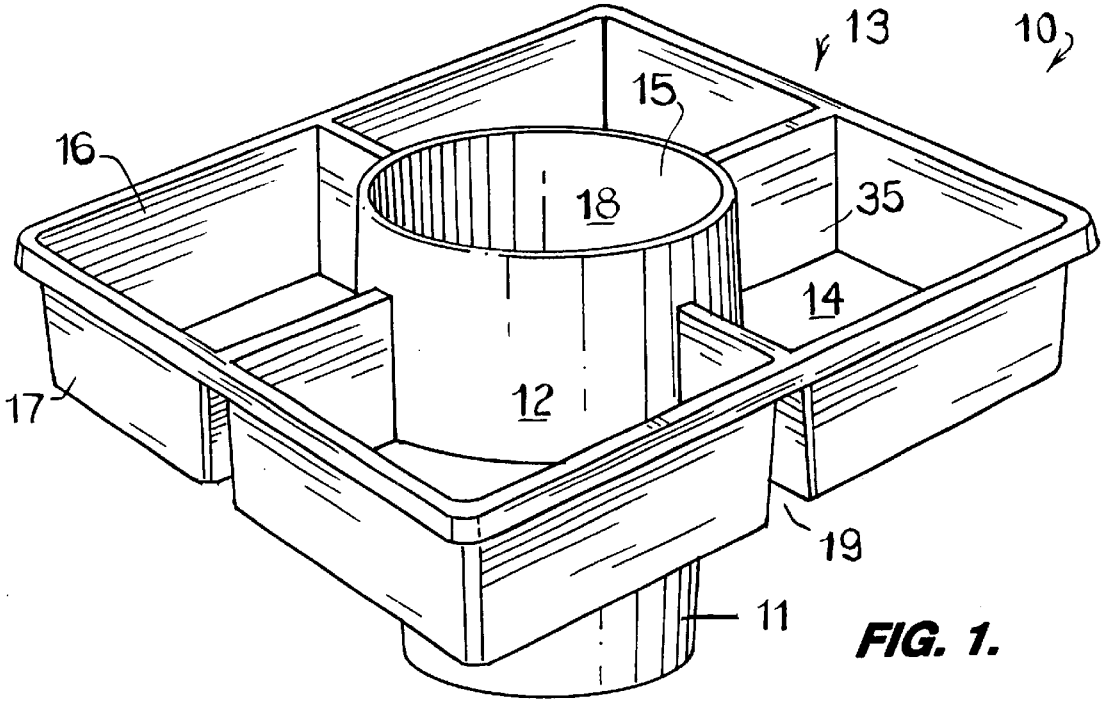
FIG. 1 shows a perspective view of an article having a tray and beverage holder integrally molded to form a single, one piece unit, in accordance with the present invention.

In the drawings, an improved article, indicated generally by the reference number 10, includes a beverage holder 15 and a serving tray 13 formed as a single, one piece unit (FIG. 1).

The beverage holder 15 defines a void, accessible through an opening 18. Preferably, the void and opening 18 are sized so that a canned beverage or, alternately, a disposable drinking cup, each of standard size, can be snap-fitted within the beverage holder, with a substantial part of the can or cup nested therein.

Figure 3:
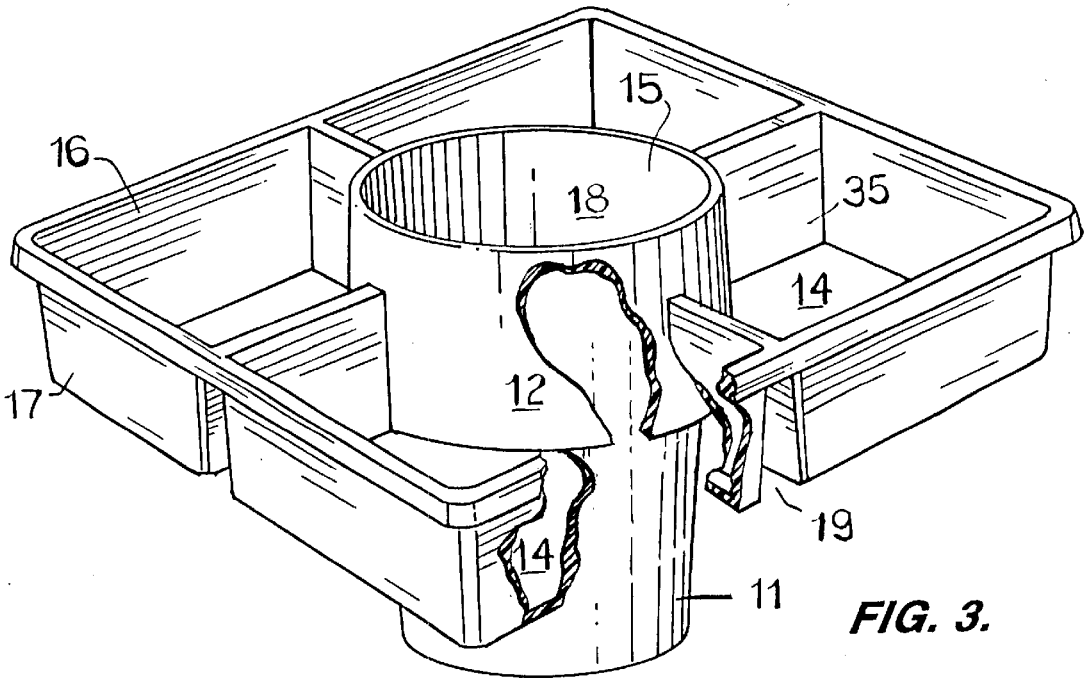
FIG. 3 shows a perspective view of a fragmentary portion of the article according to FIG. 1 in which a double-walled section of the beverage holder is partially broken away.

The lower end of a hollow portion 11, which preferably extends the full length of the beverage holder 15, forms a handle with which a user can singlehandedly support and carry the article 10. Not only does the hollow portion 11 of the beverage holder serve dual functions as receptacle and handle but also an inner side wall 12 of the tray 13 is joined along its upper edge to the hollow portion 11 forming a flared top for the beverage holder 15 (FIG. 3). In the tray 13, the inner side wall 12 is fused to bottom walls 14 and partitions 35. Together with outer side walls 17, they define a plurality of open, shallow compartments 16.

For ease of storage and transport, pairs of trays 10 can be stacked one within the other. To accomplish this stacking, the outer side walls 17 of the tray 13 and the handle 11 taper downwardly and inwardly; and the void in the beverage holder 15 expands upwardly and outwardly for receiving the handle on a second article 10. Further, the partitions 35 in the tray 13 are hollow and expand downwardly, terminating in openings 19, so that a pair of trays 13 can be nested one within another to minimize the amount of required storage space.

Figure 2:
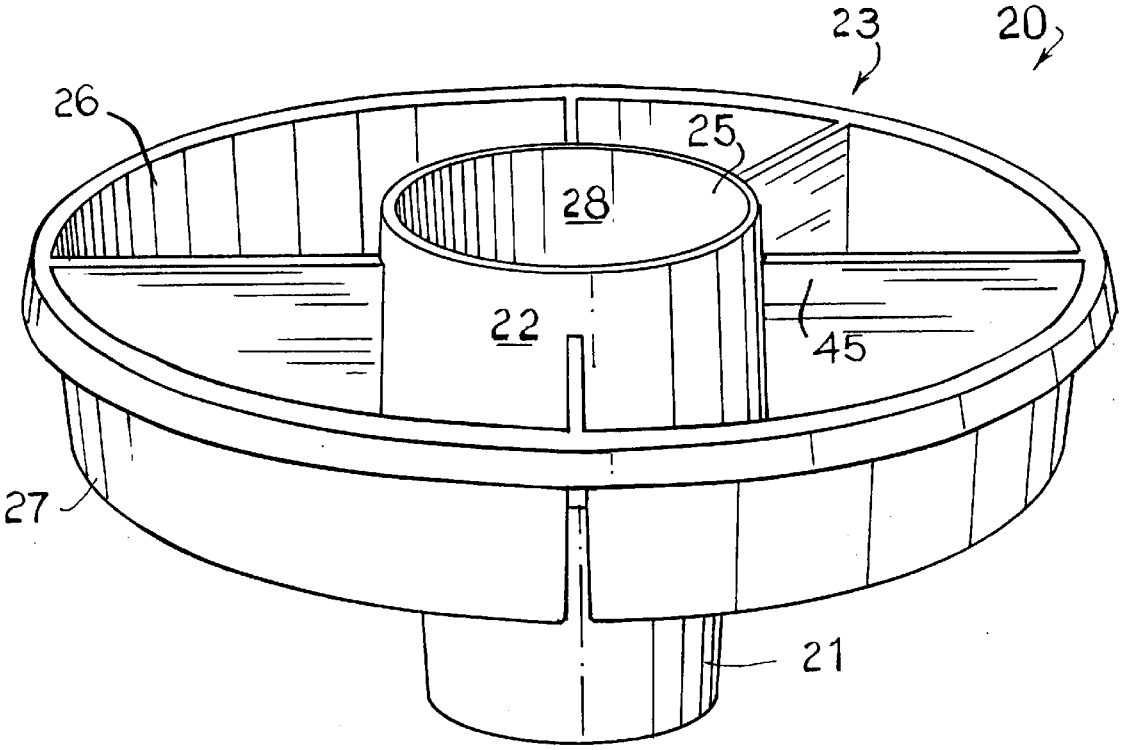
FIG. 2 shows a perspective view of an alternate embodiment of the article according to FIG. 1.

As illustrated in FIG. 1, the tray 13 has outer walls 17 whose periphery generally defines a square. This square measures, by way of example, 8 to 10 inches on a side. Alternately, an improved article 20 has a tray 23 whose outer edge is generally circular in transverse cross-section (FIG. 2). The tray 23 measures, by way of example, 8 to 10 inches in diameter. In a still further embodiment (not shown), the periphery of the tray generally defines a rectangle which measures, by way of example, 8 inches by 9 inches. So that a balance can be, achieved when the article 10 is fully loaded with food and drink, the footprint of the tray 13 exhibits at least bilateral H symmetry about the longitudinal centerline of the beverage holder 15.

To accommodate a standard size beverage can, the opening 18 and the void in the beverage holder 15 measure, by way of example, about 3 inches in diameter and 2¼ inches deep. Shallow compartments 16 with a depth in the range of ½ inch to 1 inch are preferred.

The articles 10, 20 closely resemble each other. Similarly to the article 10, the article 20 includes a beverage holder with an opening 28, a hollow portion 21, and an inner side wall 22. In the tray 23, the inner side wall 22 is fused to bottom side walls 24 and partitions 45. Together with outer side walls 27, they define a plurality of open, shallow compartments 26.

Each article 10, 20 is fabricated using a one piece mold or press. Preferably, the article is made from a thermoplastic such as polystrene or polyvinyl which measures, by way of example, 20 mil to 40 mil in thickness; however, it can also be made from a malleable metal or paper product.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

What is claimed is:

1. An article easily held by one hand, comprising a serving tray and a centrally located beverage holder integrally molded to form a single, one piece unit; the beverage holder defining a watertight, hollow portion which extends downwardly from the tray, so that said hollow portion forms a handle; the beverage holder having a generally flat bottom surface, said flat bottom surface being of sufficient area to support the unit when the beverage holder rests upon a generally horizontal surface which is similar in footprint to said flat bottom surface; the bottom surface and the tray extending generally perpendicularly to the longitudinal centerline of the beverage holder, the center of gravity of the unit being disposed along said centerline, so that when the unit is placed upright, resting on said bottom surface, the tray is held approximately level; the tray having an outer wall, at least one dividing wall, and at least one pair of watertight, shallow, open compartments, each compartment being fluidly isolated from the beverage holder; the compartments being separated by the dividing wall whose distal ends are disposed proximate with the beverage holder and the outer wall of the tray, respectively, and being disposed generally symmetrically about the longitudinal centerline of the beverage holder; the hollow portion comprising a side wall which extends downwardly from the tray, the side wall tapering inwardly; each compartment and the hollow portion roughly defining an imaginary inverted, truncated cone, so that two copies of the unit can be nested together.

2. The article according to claim 1, wherein the beverage holder is sized to receive a standard, disposable drinking cup or standard disposable soda/beer can.

3. The article according to claim 1, wherein the tray defines an outer edge which is generally circular along each transverse cross-section thereof.

4. The article according to claim 1, wherein the tray defines outer walls whose periphery generally defines a square.

5. An article according to claim 1, which further comprises a structure formed by pressing a single sheet of material.

* * * * *